United States Patent [19]

Ikeda et al.

[11] 4,268,541

[45] May 19, 1981

[54] PROCESS FOR PRODUCING A MATERIAL HAVING A VAPOR-DEPOSITED METAL LAYER, AND PROCESS FOR PRODUCING A RECORDING MATERIAL

[75] Inventors: Tomoaki Ikeda; Satoshi Yoshida; Hideaki Takeuchi; Fumiaki Shinozaki; Keishiro Kido, all of Asaka, Japan

[73] Assignee: Fuji Photo Film Co., Ltd., Minami-ashigara, Japan

[21] Appl. No.: 81,221

[22] Filed: Oct. 2, 1979

Related U.S. Application Data

[63] Continuation of Ser. No. 921,540, Jul. 3, 1978, abandoned, which is a continuation of Ser. No. 768,671, Feb. 14, 1977, abandoned.

[30] Foreign Application Priority Data

Feb. 16, 1976 [JP] Japan ..... 51-16036
Sep. 17, 1976 [JP] Japan ..... 51-111516

[51] Int. Cl.[3] ..... B05D 1/36; B05D 7/04

[52] U.S. Cl. ..... 427/177; 427/178; 427/179; 427/251; 427/255.1

[58] Field of Search ..... 427/162, 177, 178, 179, 427/251, 255.1

[56] References Cited

FOREIGN PATENT DOCUMENTS 886441 7/1949 Fed. Rep. of Germany .
1251618 10/1967 Fed. Rep. of Germany .
1269449 5/1968 Fed. Rep. of Germany .
1446270 1/1969 Fed. Rep. of Germany .
1809906 3/1971 Fed. Rep. of Germany .

*Primary Examiner*—James R. Hoffman
*Attorney, Agent, or Firm*—Sughrue, Rothwell, Mion, Zinn and Macpeak

[57] ABSTRACT

A process for producing a sheet-like material having a vapor-deposited metallic layer thereon, which comprises vapor depositing a layer of a metal, a layer of different metals in contact with each other, a layer of a metal alloy, a layer of a metal and a metal compound in contact with each other or a layer of a metal compound as the metallic layer on a support of a polymeric material having a glass transition temperature of at least about 0° C., a composite of said polymeric material and paper, woven or non-woven cloth, or paper using at least one member selected from the group consisting of metals, metal alloys and metal compounds as an evaporating material in the vapor depositing, and then forming a layer of an organic material on the metallic layer by vapor deposition using an evaporable organic material as an evaporating material in the vapor depositing.

14 Claims, No Drawings

PROCESS FOR PRODUCING A MATERIAL HAVING A VAPOR-DEPOSITED METAL LAYER, AND PROCESS FOR PRODUCING A RECORDING MATERIAL

This is a Continuation of application Ser. No. 921,540, filed July 3, 1978 which is a continuation of application Ser. No. 768,671 filed Feb. 14, 1977, both now abandoned.

BACKGROUND OF THE INVENTION

1. Field of the Invention

This invention relates to a process for producing a material having a vapor-deposited metallic layer thereon, and also to a process for producing a recording material.

More specifically, the invention relates to a process for producing a sheet-like material having a vapor-deposited metal layer, which comprises forming a metallic layer on a support by vapor deposition using a metal, a metal alloy or a metal compound or a mixture of two or more thereof as an evaporating material, and then vapor depositing an organic material on the metallic layer so as to protect the metallic layer. It also relates to a process for producing a recording material which comprises forming a metallic layer on a support by vapor deposition using a metal, a metal alloy or a metal compound or a mixture of two or more thereof, forming an organic material layer on the metallic layer by vapor deposition, and thereafter forming an organic resin layer on the organic material layer. In particular, the process for producing the recording material is characterized in that after the metallic layer is formed on the support by vapor deposition, additional steps are performed in which an organic material is vapor-deposited on the metallic layer and thereafter an organic resin layer is coated thereon in order to prevent the occurrence of imperfections on the metallic layer, such as pinholes and scratches.

2. Description of the Prior Art

In recent years, techniques for forming vapor-deposited layers of metals, metal alloys or metal compounds, etc. on supports have been actively studied and developed, and have come into wide commercial acceptance. As a result, vapor-deposited layers of aluminum, zinc, silver, copper, cadmium or the like formed by vapor deposition on organic supports such as polyethylene terephthalate, polycarbonate, unplasticized polyvinyl chloride, and cellulose acetates are used in various applications, for example, as gold and silver yarns, decorations, foils, packaging materials, labels, transfer marks, or adhesive tapes. More recently, a wider range of utility has been found in electronic and electrical materials such as condensers and printed circuit boards, and magnetic recording tapes and photographic materials.

The formation of metallic layers by vapor deposition comprises heating a metal, a metal alloy or a metal compound in a vacuum of about $10^{-4}$ torr to about $10^{-5}$ torr, and condensing the resulting vapor on the surface of a support disposed in the vacuum. The metallic layers so formed generally suffer from the serious defect of having a weak mechanical and physical strength and are susceptible to scratching although the degree of the defect varies depending on the kind of the support. In order to avoid such a defect, it is now general practice, particularly in the production of, for example, gold and silver yarns, decorations and packaging materials, to coat a resin layer on the metal layer for protective purposes. The resin layer is formed generally from epoxy resins, polyurethane resins, alkyd resins, melamine resins, phenolic resins and butyral resins. Vapor deposition techniques are well known and are described in *Handbook of Thin Film Technology,* L. I. Maissel and R. Glang (editors) McGraw-Hill Book Company, (1970). *Metallizing of Plastics,* H. R. Simonds (editor) Reinhold Publishing Corporation, (1960) etc.

The vapor deposition apparatus widely used for the production of vapor-deposited layers is a so-called semi-continuous-type vapor deposition apparatus in which a roll of a long strip of a support is disposed within a vacuum vessel, continuously delivered from a delivery spindle, and vapor-deposited in a vacuum chamber provided in a space between the above spindle and another spindle for winding up the support. This apparatus includes a support conveying mechanism for delivering the support in a roll form from the spindle, conducting the support to the vacuum chamber, and continuously winding up the vapor-deposited support in a roll form. Such a conveying mechanism usually contains one or more conveyor rollers, and generally the vapor-deposited layer formed on the support in the vacuum chamber contacts with one or more conveyor rollers until the support is wound up in a roll on the spindle. This results in the occurrence of an innumerable number of pinholes and scratches on the vapor-deposited layer, and therefore, this deteriorates the quality of the vapor-deposited layer. When aluminum is used as an evaporating metal and polyethylene terephthalate is used as a support, pinholes having a diameter of about 10 $\mu$m to about 50 $\mu$m occur to a degree of about 50 to about 100 per $cm^2$ on the aluminum layer on contact with a single roll even if the conveyor roll is an ordinary one which has a hard chromium plating thereon, which has good surface smoothness and which is free from surface scars (the occurrence of pinholes and scratches depends upon the materials of the conveyor rolls, the surface smoothness thereof and the torque of the conveyor roll). When scars are present on the surface of the conveyor roller, scratches or pinholes corresponding to the scars occur in the metallic layer.

Furthermore, at the time of winding up the vapor-deposited support on a spindle, the vapor-deposited layer contacts the back of the previously wound-up support, and a number of scratches and pinholes occur in the metallic layer as a result of friction due to the fluctuations in tension, that is, the so-called "wind-up tightening".

It is possible to utilize vapor deposition devices which include a conveyor mechanism having one or more conveyor rolls which contact only the back of the support and which do not at all contact the vapor-deposited metallic layer in the conveying path after the formation of the vapor-deposited metallic layer until the support is wound up in roll on a spindle, or a conveyor means which does not utilize a conveyor roll in the conveying passage, although this practice has not come into wide acceptance. Even so, when the support is wound up in a roll form by a spindle, it is impossible to prevent the occurrence of scratches and pinholes in the metallic layer due to "wind-up tightening".

Moreover, in coating an organic resin layer as a protective coating on the vapor-evaporated metallic layer on the support, one or more conveyor rolls which contact the metallic layer and cause a number of pinholes and scratches in the metallic layer are disposed in a conveying passage through which the support having the metallic layer formed thereon which has been wound up in a roll form is conveyed from a spindle in a continuous coating device to a section for coating the organic resin on the support.

As described above, there are many sites which cause pinholes and scratches in the metallic layer in the passage from the vapor deposition section of a semi-continuous type vapor deposition apparatus to the coating section of the continuous coating device, and the number of pinholes and scratches in the metallic layer increases as the support passes these sites successively.

On the other hand, another type of vapor deposition apparatus is widely used in which one or more sheet-like supports are disposed in a vacuum vessel and by vapor deposition a vapor-deposited metallic layer is formed on the surface of the support. Since the support is in a sheet form and not in a roll form, neither conveying nor winding of the support is required. Hence, it is possible to produce a vapor-deposited metallic layer completely free from scratches and having a very low pinhole density. If in a subsequent step of forming an organic resin layer, thereon a high-speed rotary coater called a whirler is utilized, pinholes and scratches do not occur in this step, too. Consequently, it is possible to produce a material having a high quality vapor-deposited metallic layer which is substantially free from pinholes and scratches. This method has the disadvantage of extremely poor productivity, and is quite unsuitable for mass production.

Therefore, difficulties with conventional techniques are encountered in producing a high quality material having a vapor-deposited metallic layer free from imperfections such as pinholes and scratches at low cost on a mass-production basis, and this poses a serious problem both in the utility of the product and in industrial feasibility.

In some applications of gold and silver yarns, decorations and packaging materials, materials having metallic layers with many imperfections such as pinholes or scratches may be used without detrimental effects. However, a protective coating must be formed by coating using a continuous coating device, and great costs must go into its installation. Furthermore, since such materials are produced using the technically different steps of vapor deposition and coating, the production of these materials has the disadvantage of poor efficiency and economic infeasibility.

The recording materials to be produced by the process of this invention means materials consisting basically of a support, a metallic layer formed on the support, and at least a photosensitive resin layer formed on the metal layer, which are classified into image-forming materials in which an image is formed by exposing the material, developing the photosensitive resin layer, and etching away the metallic layer using the resin layer as a resist (that is, a two-bath processing-type image-forming material which requires a developer for the photosensitive resin (or a photoresist) layer and an etching solution for the metal layer), and a mono-bath processing type image-forming material having the same basic structure as the two-bath processing type image-forming material, which, however, requires only one processing solution for developing the photosensitive resin layer and etching the metal layer as described in the specifications of Japanese Patent Application (OPI) Nos. 65927/73, 65928/73, and 139720/75; materials comprising basically a support and at least a metallic layer formed thereon and if desired, a resin layer formed on top of the metal layer, by which recording is performed by irradiating with high density irradiation energy by, for example, a laser or a flash lamp to deform or remove a part of the metallic layer by a thermal method such as melting, evaporation or coagulation, thus providing differences in light transmittance and reflectance, as disclosed in the specifications of Japanese Patent Publications Nos. 2774/67 and 40479/71, and Japanese Patent Application (OPI) Nos. 96716/74 and 19303/73; or materials comprising basically a support, a ferromagnetic metal layer formed thereon, and a resin layer coated on the metallic layer, by which information is recorded using electromagnetic radiation energy, followed, if desired, by development and etching, thereby to provide a difference in the physical condition between the part exposed to the energy and the part which was not exposed to the energy. A method, similar to the process of this invention, can be applied by vapor deposition to the production of magnetic recording materials for recording information by a magnetic method.

The production of the recording material roughly comprises a step of forming a metallic layer on a support by vapor deposition and a step of coating an organic resin layer on the metal layer.

Japanese Patent Publication No. 37435/71 discloses a metal vapor deposition method for vapor depositing a thermoplastic resin on a vapor-deposited metallic layer in the same vacuum system. The purpose of this method is to prevent the peeling of the metallic layer from the support made of a non-polar polyolefin by increasing the adhesion between the support and the metallic layer, and to inhibit the corrosion of the vapor-deposited metallic layer. In order to achieve such purposes, it is essential to adhere a thermoplastic resin in a thickness of about 1 $\mu$m to the vapor-deposited metallic layer in the same vacuum system immediately after the vapor deposition of the metallic layer, and the purposes cannot be achieved if the thickness of the resin is less than this specified value. However, thermoplastic resins generally have extremely high vapor pressures when heated, and therefore, this adversely affects the vapor deposition of metal, and with the method disclosed in Japanese Patent Publication No. 37435/71, it is difficult to produce a material having a vapor-deposited metallic layer which has superior properties and a uniform quality. Moreover, no method is suitable for the production of recording materials which includes a step of vapor depositing a layer of an organic material that renders the etching of the metal layer time-consuming at the time of image formation and thus impairs the etchability of the metal layer. The provision of a thermoplastic resin layer having a thickness of about 1 $\mu$m as the organic material is quite unsuitable for the production of recording materials.

SUMMARY OF THE INVENTION

Extensive investigations have now been made in an attempt to solve such serious problems associated with conventional techniques as described above. Consequently, we have found that by providing vapor deposition chambers divided into a metal depositing section and an organic material depositing section by means of a partition, depositing a vapor of a metal on a support in the metal depositing section of the chamber, to form a metallic layer and subsequently forming an organic material layer on the metallic layer using a high-molecular-weight or low-molecular-weight organic material as an evaporating material, the vapor deposition of both layers can be performed without any substantial interaction between the metal and the organic material, and at the same time, the serious problems described above can be solved.

A first object of this invention is to provide a process for vapor deposition of metal so as to produce a sheet-like material having a vapor-deposited metallic layer free from pinholes and scratches.

A second object of the invention is to provide a process for producing a sheet-like material having a vapor-deposited metallic layer on which a protective layer is formed by a vapor deposition step alone.

A third object of the invention is to provide a process for producing a high quality recording material free from pinholes and scratches.

A fourth object of the invention is to provide a process for producing the above recording material on a mass-production basis.

A fifth object of this invention is to provide a process for producing the above recording material at low cost.

One or more of the above objects are achieved by a process for producing a sheet-like material having a vapor-deposited metallic layer thereon, which comprises forming a metallic layer on a support comprising a polymeric material having a glass transition temperature of at least about 0° C., a composite of such a polymeric material and paper, woven or non-woven cloth, or paper alone by vapor deposition of at least one member selected from metals, metal alloys and metal compounds as an evaporating material, and then forming on the metallic layer a layer of an organic material by vapor deposition using an evaporable organic material as an evaporating material.

One or more of the above objects are achieved also by a process for producing a recording material, which comprises forming a metallic layer on a support by vapor deposition using at least one member selected from the group consisting of metals, metal alloys and metal compounds as an evaporating material, then forming a layer of an organic material on the metallic layer by vapor deposition using an evaporable organic material as an evaporating material, and thereafter forming on the organic material layer a layer of an organic resin, an organic resin composition, or a photosensitive organic resin composition.

One or more of the above objects are achieved with a sheet-like material having a vapor-deposited metallic layer, which comprises providing a vapor depositing chamber divided by partitions into two or more sections, forming a metallic layer on a support comprising a polymeric material having a glass transition temperature of at least about 0° C., a composite of the polymeric material and paper or paper alone by vapor deposition in a first chamber using a metal, a metal alloy or a metal compound or a mixture of two or more thereof as an evaporating material, and then forming a layer of an organic material by vapor deposition in a second chamber using an evaporable organic material as an evaporating material.

One or more of the above objects are achieved by a process for producing a recording material, which comprises providing a vapor depositing chamber divided by partitions into two or more sections, forming a metallic layer on a support comprising a polymeric material having a glass transition temperature of at least about 0° C., a composite of the polymeric material and paper, woven or non-woven cloth, or paper alone by vapor deposition in a first chamber using a metal, a metal alloy or a metal compound or a mixture of two or more thereof as an evaporating material, then forming a layer of an organic material by vapor deposition in a second chamber using an evaporable organic material as an evaporating material, and thereafter forming a layer of an organic resin, an organic resin composition or a photosensitive organic resin composition on the organic material layer.

DETAILED DESCRIPTION OF THE INVENTION

The process of the present invention is described below in greater detail.

The process of this invention in one embodiment involves the steps of vapor depositing a metallic layer and a layer of an organic material on a support. The process of this invention in another embodiment also comprises the steps of vapor depositing a metallic layer and a layer of an organic material, and a step of forming a layer of an organic resin, an organic resin composition or a photosensitive organic resin composition on a support.

Methods for vapor depositing the metallic layer and the organic material layer used in this invention include a vapor deposition method, a sputtering method, and an ion plating method. The vapor deposition method is described below as a typical example but the invention is not to be construed to be limited to such as the vapor depositing method which can be used in this invention.

In the vapor depositing step, a roll of a long strip of a support is mounted on a delivery spindle in a vacuum vessel, and disposed so that by conveyor mechanism, the support is delivered continuously from the delivery spindle, passes a vapor deposition chamber for a metal, a metal alloy, or a metal compound as an evaporating material and then a vapor depositing chamber for an organic material, and wound up on a wind-up spindle. The inside of the vacuum vessel is maintained at a high vacuum of about $10^{-3}$ torr to about $10^{-6}$ torr by means of an evacuation device. While continuously conveying the support by delivering the support from the delivery spindle and winding the support up on the wind-up spindle, a metal, a metal alloy or a metal compound (to be referred to hereinafter simply as a metal) is evaporated by a heating device provided in the vapor deposition chamber, and the resulting vapor is deposited and condensed on the surface of the support to form a metallic layer. Then, in a vapor deposition chamber in which a conveyor roll is not used between this chamber and the metal deposition chamber, an evaporable organic material is evaporated by a heating device provided in the chamber, and the vapor of the organic material is deposited and condensed on the metallic layer to form a layer of the organic material. After the vapor deposition of the organic material, the coated support is wound up in a roll on the wind-up spindle via conveyor rolls, if desired.

When it is desired to produce a recording material, the wound-up material having the metallic layer and the organic material layer is unwound outside of the vacuum vessel and a layer of an organic resin, an organic resin composition or an photosensitive organic resin composition is formed on the organic material layer using known methods. Alternatively, after the formation of the metallic layer and the organic material layer, a layer of an organic resin, an organic resin composition or a photosensitive organic resin composition is formed on the organic material layer using known methods, and then the material is wound up in a roll form or cut into a sheet form either directly or after it has been subjected to a drying step.

In a preferred embodiment of the process of this invention, a metallic layer is formed by vapor deposition in the same manner as described above, and then, in a chamber for vapor depositing an organic material with a partition between this chamber and the metal vapor depositing chamber but without any conveyor roll therebetween, an evaporable organic material is evaporated by a heating device provided therein, and the resulting vapor is deposited and condensed on the metallic layer previously formed. After the formation of such an organic material layer by vapor deposition, the material is wound up in a roll form on a wind-up spindle, if desired, via conveyor rolls.

The following description is directed mainly to the process of this invention which is performed using a vapor deposition chamber including a partition which is not essential but quite preferred between a chamber for evaporating a metal and a chamber for evaporating an evaporable organic material.

In the vapor deposition chamber, a partition is provided between the chamber for evaporating the metal and the chamber for evaporating the organic material in order to substantially prevent the co-presence of vapors of the metal and the organic material in the vapor deposition chamber (hence, the partition substantially prevents the vapor deposition of the metal, the metal alloy or the metal compound and the vapor deposition of the organic substance from affecting each other). The partition is provided in such a manner that it does not contact the metallic layer formed on the support, nor does it impede the conveyance of the support on which the metal laver has been formed. It is further necessary that the distance between the partition and the support be as small as possible. The partition can be suitably constructed of the same material as the vapor deposition apparatus e.g., cast iron, stainless steel, etc.

Experimentally it has now been shown that the position of the partition and the distance between the metallic layer on the support and the edge portion of the partition can be varied over wide ranges, and they can also be varied depending on the combinations of the metal, the metal alloy or the metal compound and the organic material. Although those skilled in the art can easily determine the position of the partition and the distance between the metallic layer on the support and the edge of the partition by simple experiments prior to the performance of the process of this invention, it is usual for the partition to be provided midway between the two evaporation sources in the vapor-deposition chamber, and the distance between the metallic layer on the support and the edge portion of the partition to range from about 0.2 mm to about 10 mm. Preferably, the width of the partition is larger than that of the support. The thickness of the edge portion of the partition, as measured in the direction of conveying the support, is larger than the minimum thickness with which the mechanical strength of the partition can be maintained. Specifically, a sufficient thickness for the partition is at least about 1 mm. The two evaporation sources may be present within the same vacuum system (in which case the degree of vacuum is substantially the same on both sides of the partition), or may be present in a different vacuum system easily controlled by the degree of evacuation.

The pressure within the vapor depositing chamber at at which a material for the metallic layer is evaporated and deposited on the support ranges from about $10^{-3}$ torr to about $10^{-6}$ torr. When the pressure is higher than about $10^{-3}$ torr, the evaporating material is oxidized by oxygen in the air present in the vapor deposition chamber, and the intended metallic layer cannot be obtained. When the pressure is lower than about $10^{-6}$ torr, the intended metallic layer can be obtained, but on the other hand, a very large amount of energy is required to maintain such a high vacuum, and the pressure-reduction or vacuum device must have a very large size, leading to disadvantages both economically and from the standpoint of equipment design. The pressure within the vapor deposition chamber at which the evaporating material for the organic material layer is evaporated and deposited on the metallic layer ranges from about $10^{-1}$ torr to about $10^{-4}$ torr. Since organic materials generally have a high vapor pressure, the pressure within the vapor deposition chamber does not easily decrease due to the presence of a large amount of vapor from the organic material within the chamber. On the other hand, vapor deposition of the organic material on the metallic layer proceeds conveniently at relatively high pressures of about $10^{-1}$ to about $10^{-4}$ torr, and by operating within this pressure range, the energy efficiency for pressure reduction is good, and the pressure-reducing device may be of moderate size, thus affording economic advantages.

The support is made of, for example, a film of an organic polymeric material having a glass transition temperature of at least about 0° C., paper, a cloth (both woven, and non-woven), or a composite of these. A transparent, translucent or opaque material can be selected as desired depending on the purpose of using the resulting material. Examples of suitable organic polymeric materials having a glass transition temperature (Tg) of at least about 0° C., with there being no restriction on an upper limit for the glass transition temperature, are polyethylene terephthalate (Tg:69° C.), polyethylene isophthalate (Tg:51° C.), bisphenol A polycarbonate (Tg:145° C.), unplasticized polyvinyl chloride (Tg:81° C.), cellulose triacetate (Tg: more than 49° C.), cellulose butyrate acetate, cellulose tributyrate (Tg: 115° C.), cellulose acetate propionate, cellulose nitrate (Tg: more than 53° C.), and polystyrene (Tg:100° C.). Polyethylene terephthalate and bisphenol A polycarbonate are preferred. Sheets, films laminated composites of two or more of these sheets or films, and laminated composites of these sheets or films and paper can be used. Sheets and films of polyolefins exemplified by polyethylene and polypropylene whose surfaces have been treated with a corona discharge, a flame treatment or a gas containing a large quantity of ozone, and laminated composites thereof with paper can also be used as the support in the process of the present invention. Of the above examples, films and sheets of polyethylene terephthalate and polycarbonate of bisphenol A are used preferably in the process of this invention because of their dimensional stability and ease of handling. The thickness of the sheet or film usually ranges from about 5 μm to several millimeters e.g., to about 3 mm preferably about 15 μm to about 1 mm, especially preferably from about 50 μm to about 500 μm.

When recording materials e.g., magnetic recording materials, are to be produced by the process of this invention, not only polymeric materials having a glass transition temperature of at least about 0° C. but also other suitable polymeric materials selected from widely known polymeric materials, for example, polyethylene, polypropylene, nylon etc., can be used as the support. Polymeric materials having a glass transition temperature of at least about 0° C. are preferred, however.

The metal evaporating material is not limited to metals in the narrow sense, but may include semi-metals and semi-conductors. Typical examples include aluminum, antimony, beryllium, bismuth, cadmium, chromium, copper, gallium, germanium, gold, indium, cobalt, iron, lead, magnesium, manganese, nickel, palladium, rhodium, selenium, silicon, silver, strontium, tellurium, titanium, tin, tungsten, molybdenum, vanadium, and zinc. Suitable metal alloys comprise at least two metals and include, for example, alloys such as aluminum-silver, aluminum-bismuth, aluminum-iron, bismuth-indium, bismuth-tin, indium-tin, and iron-cobalt alloys.

A metallic layer formed by vapor depositing a single metal as an evaporating material comprises the same metal as the evaporating material. On the other hand, a metallic layer obtained by vapor deposition of a metal alloy as an evaporating material, in many cases, comprises a metal alloy having a different composition from the evaporating material, although it sometimes has the same composition as the metal alloy evaporated. Or the metallic layer obtained is a metal alloy layer which does not have a uniform composition throughout. Or it is a metal layer in which the constituents of the alloy used as the evaporating material contact each other and contact each other in various ways. It is also within the scope of the invention to intentionally form by vapor deposition a metallic layer in which different metals are present in contact with each other.

Furthermore, a metal compound may be used as the evaporating material to form a vapor-deposited layer of the same metal compound as or a different metal compound from the evaporating material. In addition, at least two of the above-described metals, metal alloys and metal compounds can be used as the evaporating material. All forms of metal layers which are disclosed in Japanese Patent Application (OPI) No. 139720/75 (corresponding to U.S. Patent Application Ser. No. 571,817, filed Apr. 25, 1975) which is herein incorporated by reference can be utilized in the process of the present invention.

The thickness of the metallic layer is that thickness required for the recording material produced by the process of this invention to exhibit the function necessary, and differs depending, for example, on the types of the metal, different metals present in contact with each other, or metal alloy. Generally, a suitable thickness is from about 30 nm to about 600 nm, preferably from about 40 nm to about 300 nm.

Generally, the thickness of the metallic layer is proportional to the optical density of the metallic layer although this differs depending on the composition (metal, metal alloy or metal compound or mixtures thereof) of the metal layer. In the case of a layer of an aluminum-iron alloy (composed of about 90 to 99.9 atomic % aluminum and about 0.1 to 10 mole % iron), thicknesses corresponding to an optical density of 2.0, 3.0, 3.5 and 4.0 are about 40 nm, about 60 nm, about 70 nm and about 80 nm, respectively. In the case of a silver layer, thicknesses corresponding to an optical density of 2.0, 3.0 and 3.5 are about 70 nm, about 120 nm and about 140 nm, respectively. The thicknesses of a copper layer corresponding to an optical density of 2.0, 3.0 and 3.5 are about 100 nm, about 150 nm and about 175 nm, respectively. In the case of an indium layer, the thickness corresponding to an optical density of 3.5 is about 60 nm. A bismuth layer with a thickness of about 75 nm has a corresponding optical density of 4.0, and a layer composed of a mixture of tin and stannous sulfide with a thickness of about 130 nm has a corresponding optical density of 4.0. The term optical density as used herein refers to the transmission optical density.

In the present invention, the organic material layer serves as a buffering layer for the metallic layer, and renders the metallic layer formed by vapor deposition more slippable. This increases the effect of the organic material layer as a protective layer. In other words, the organic material layer absorbs and minimizes all actions which result from external forces such as the contact of the metallic layer with conveyor rolls, wind-up tightening, or scratching during handling and which cause pinholes and scratches in the metallic layer, thus serving to prevent the occurrence of pinholes or scratches in the metallic layer. It has been confirmed that the organic material layer does not increase the bond strength (adhesive force) between the support and the vapor-deposited metallic layer.

The organic compound used in the present invention to perform the above function is at least one compound selected from the group consisting of homopolymers and copolymers containing in any proportion recurring units derived from acrylic acid or methacrylic acid (to be referred to hereinafter simply as an acrylic or methacrylic polymer) such as polyacrylic acid, polymethacrylic acid, a copolymer of acrylic acid and methacrylic acid, a copolymer of benzyl acrylate and acrylic acid, a copolymer of benzyl acrylate and methacrylic acid, a copolymer of benzyl methacrylate and acrylic acid, a copolymer of benzyl methacylate and methacrylic acid, a copolymer of styrene and methacrylic acid, a copolymer of phenethyl acrylate and acrylic acid, a copolymer of phenethyl acrylate and methacrylic acid, a copolymer of phenethyl methacrylate and acrylic acid, and a copolymer of phenethyl methacrylate and methacrylic acid; low-molecular-weight organic compounds containing a carboxyl group such as rosin, abietic acid, neoabietic acid, dihydroabietic acid, tetrahydroabietic acid, d-pimaric acid, phthalic acid, isophthalic acid, terephthalic acid, succinic acid, sulfanilic acid, Rhodamine B, and saturated fatty acids containing 14 to 29 carbon atoms (such as myristic acid, palmitic acid, stearic acid, arachidic acid, behenic acid, lignoceric acid, and cerotic acid; phthalocyanines; and mono- and oligosaccharides such as sucrose, fructose, glucose, and sorbitol.

Of the above compounds, polyacrylic acid, polymethacrylic acid, acrylic acid/methacrylic acid copolymer, benzyl methacrylate/acrylic acid copolymer, benzyl methacrylate/methacrylic acid copolymer, styrene/acrylic acid copolymer, styrene/methacrylic acid copolymer, rosin, abietic acid, neoabietic acid, isophthalic acid, succinic acid, sulfanilic acid, palmitic acid, stearic acid, behenic acid, phthalocyanines, and Rhodamine B are preferred.

The above-mentioned effect is achieved when the thickness of the vapor-deposited organic material layer is at least about 30 nm. Preferably with a thickness of at least about 60 nm, more preferably with a thickness of at least about 100 nm, pinholes and scratches due to contact with conveyor rollers and wind-up tightening at the time of wind up scarcely occur. In order for the organic material layer to function sufficiently as a protective layer, the thickness of the layer preferably ranges from about 100 nm to about 3 μm. If required, an organic material layer having a thickness of more than about 3 μm can be formed without any detrimental effect. In recording materials to be produced by the process of the present invention, the formation of an organic material layer with such a thickness as will cause etching at the time of image formation to be extremely time-consuming should be avoided, and therefore, suitable thicknesses are below about 600 nm.

The organic material layer formed by the process of this invention using the acrylic or methacrylic polymer a low-molecular-weight organic compounds containing a carboxyl group, phthalocyanine, a monosaccharide or an oligosaccharide as an evaporating material sufficiently functions as a protective layer, and effectively prevents the occurrence of defects such as pinholes and scratches in the metallic layer. Furthermore, the organic material layer has sufficient mechanical strength. It is surprising and has not been anticipated heretofore that an organic material layer with such a thickness would have sufficient mechanical strength. Furthermore, when a layer of a photosensitive resin composition, a different organic material (to be referred to as a second organic material) or an inorganic material is formed on the organic material layer, the organic material in the layer formed by the process of this invention forms an integral structure with the layer of the second organic material or inorganic material, and has a high tendency to perform substantially the same function as a single organic material layer. For example, when a layer of a photosensitive resin composition is formed on the organic material layer formed by the process of this invention, these two layers substantially function as a single layer. Specifically, when the photosensitive resin composition layer is exposed imagewise and developed with a liquid or developed by a dry method such as development by peeling off, the organic material layer is removable together with the photosensitive resin composition which is to be removed corresponding to the imagewise exposure. In order for the organic material layer to become substantially an integral part with the layer of photosensitive resin composition, the organic material vapor-deposited to form the organic material layer should be soluble in a solvent contained in the photosensitive resin composition; or should have a good compatibility with the photosensitive resin composition; or the organic material layer and the layer of photosensitive resin composition should be compatibile with each other at their interface, and the components should change gradually from the components of the organic material layer to the components of the layer of photosensitive resin composition so that the two layers become substantially integral with each other. All of the evaporable organic materials used in this invention meet this requirement. As another example, the organic material layer formed by the process of this invention is composed of an organic material which when the second organic material layer is formed thereon, becomes an integral part of the second organic material layer just as in the case of providing the photosensitive resin composition layer, and performs the same function as a substantially single organic material layer.

The sheet-like material having a vapor-deposited metallic layer as produced by the process of the invention described above has high quality without defects such as pinholes and scratches, and scratching does not occur in subsequent handling. Thus, it is not necessary as in conventional methods to coat a protective layer thereon, and it is possible to produce a sheet-like material having a high quality vapor-deposited metallic layer substantially free from pinholes and scratches and having a high scratch resistance. The commercial value of the process of the invention is therefore very high.

The formation of a metallic layer has been described hereinabove with particular reference to vapor deposition. The metallic layer can be formed also by a sputtering method, an ion plating method or a combination of these, methods and such methods can also be used to achieve the objects of this invention.

A recording material can be produced by mounting the roll produced in the vapor depositing steps on a delivery spindle of a coater, continuously conveying the support as produced above from the delivery spindle to the coating section, coating an organic resin solution on the organic material layer at a coating section, and conveying the thus coated element to a drying section to dry it and thus form an organic resin layer thereon. The organic resin solution can be selected freely from a solution of a photosensitive resin composition (or a photoresist composition), or a solution of a non-photosensitive resin or a composition containing the non-photosensitive resin. For example, solutions of various known photosensitive resin compositions for forming resists can be used as the solution of the photosensitive resin composition. Examples of suitable photosensitive resin compositions include all compounds such as monomers, prepolymers or polymers whose molecular structures chemically change within short periods of time after exposure to actinic light, and whose physical properties such as solubility in solvents change accordingly. Specific examples are quinone diazides, diazonium salts, azide compounds, and compounds having a cinnamoyl group therein. Photosensitive materials of the above types are disclosed in detail in U.S. Pat. Nos. 1,762,033, 2,852,379, 2,940,853, 3,475,176, 3,261,686, etc. The solution of a non-photosensitive resin or a composition containing resin may be solutions of compounds other than the photosensitive resin compositions, and specific examples include an epoxy resin a vinyl chloride/vinyl acetate copolymer, a polyurethane resin, a vinylidene chloride resin, a cellulose nitrate resin, a styrene/butadiene rubber, an alkyd resin, a phenol resin, a butyral resin or a composition containing such a resin. If desired, known additives such as plasticizers or fillers can be incorporated, into the composition.

Coating can be carried out using known coating methods such as gravure roll coating, Meyer bar coating, doctor blade coating, reverse coating, dip coating, air knife coating, or fountain coating. A suitable thickness of the organic resin layer can range from about 0.2 to about 10 μm.

The purpose of forming the organic material layer by vapor disposition is to prevent the occurrence of pinholes and scratches which is due to contact between the vapor-deposited metal layer and conveyor rolls at the time of passing of the support over the conveyor rollers in the vapor deposition steps, wind-up tightening at the time of wind-up, or contact of the metallic layer with conveyor rollers in the coating step. In other words, the invention prevents the occurrence of these defects in the manufacturing process. Thus, once the organic resin layer has been coated, it serves to protect the metal layer. Thus, the organic material layer may be composed of an organic material which, at the time of coating the organic resin layer, is completely or partly soluble or dispersible in the coating solution, and included in the organic resin layer. Sometimes, a layer composed of such an organic material is preferred.

The following Examples are given to illustrate the process of this invention more specifically in greater detail. Unless otherwise indicated herein, all parts, percents, ratios and the like are by weight.

EXAMPLE 1

A roll of a long strip of a polyethylene terephthalate film having a thickness of 100 μm as a support was disposed within a semi-continuous vapor deposition apparatus, and indium placed in a tungsten crucible was heated in a vacuum of $5\times10^{-5}$ torr to evaporate the indium. The resulting indium vapor was deposited on the film conveyed at a rate of 40 m/min. to form a vapor-deposited indium layer having a thickness of about 60 nm (transmission optical density: 5.5). Then, rosin placed in a stainless steel crucible disposed apart from the tungsten crucible with a partition therebetween was heated to evaporate the rosin, and the rosin vapor was deposited on the indium layer until a thickness monitor indicated that the thickness of the rosin was about 100 nm. The coated film was then wound up in the form of a roll. No conveyor roll was used between the indium depositing section and the rosin depositing section, and after the deposition of the rosin layer, the film passed two conveyor rollers whose surfaces had a hard chromium plating thereon which contacted the vapor-deposited rosin layer before it was wound up.

The resulting material having vapor-deposited layers was carefully observed under transmitted light for pinholes, but only some pinholes which had been present in the as-formed vapor-deposited layer were observed, and no increase in pinholes was seen. Moreover, no defects such as scratches were observed, and the vapor-deposited layers had a good quality.

When a scratching test was performed using a stainless steel needle whose tip had a radius of curvature of 0.4 mm, it was found that scratches occurred under a load of less than 0.1 g on a vapor-deposited layer only of indium, but than an indium layer having a top coating of rosin deposited by vapor deposition withstood a load of up to 500 g and no scratching occurred.

EXAMPLE 2

A roll of a long strip of a polyethylene terephthalate film with a thickness of 100 μm as a support was placed in a semi-continuous vapor depositing aparatus, and in a vacuum of $5\times10^{-5}$ torr, aluminum placed in a carbon crucible was heated to evaporate the aluminum and the aluminum vapor was deposited on the film conveyed at a rate of 40 m/min. to form an aluminum layer having a thickness of about 30 nm (transmission optical density: 1.5). Then, a mixture of abietic acid and behenic acid (weight ratio: 50:50) placed in a stainless steel crucible disposed apart from the carbon crucible with a partition therebetween was heated to evaporate the acid mixture. The vapor of this acid mixture was deposited on the vapor-deposited aluminum layer until a thickness monitor indicated that the thickness of the layer was about 600 nm. The film so coated was then wound up in a roll form. No conveyor roller was used between the aluminum vapor depositing section and the section for vapor depositing the mixture of abietic acid and behenic acid. After the deposition of the mixture of abietic acid and behenic acid, the film passed two rollers, whose surfaces had a hard chromium plating thereon which contacted the vapor-deposited layer before it was wound up.

The resulting material having the vapor-deposited layers thereon was carefully observed under transmitted light for pinholes, but only some pinholes which had been present in the as-formed vapor-deposited layer were observed, but no increase in pinholes was seen. Moreover, no defects such as scratches were observed, and the vapor-deposited layers had a good quality.

A scratching test was performed in the same manner as in Example 1, and it was found that no scratching occurred in the vapor-deposited layers even when a load of up to 800 g was exerted thereon. The vapor-deposited aluminum layer alone was scratched under a load of less than 0.1 g.

EXAMPLE 3

A roll of a long strip of a 100 μm-thick polyethylene terephthalate film (support) was placed in a semi-continuous vapor depositing apparatus, and in a vacuum of $5\times10^{-5}$ torr, tin placed in a tungsten crucible and stannous sulfide placed in a tungsten crucible arranged in juxtaposition thereto were heated to evaporate them, and vapors of these metals were vapor-deposited on the film conveyed at a rate of 20 m/min. to form a vapor-deposited layer having a thickness of about 130 nm (transmission optical density: 4.0) in which the tin and stannous sulfide contacted each other. Then, a copolymer of styrene and acrylic acid (weight ratio: 74.3:25.7) was placed in a stainless steel crucible disposed apart from the above-described two crucibles with a partition therebetween to evaporate the copolymer. The vapor of the copolymer was deposited on the vapor-deposited metallic layer in which the tin and stannous sulfide contacted each other until a thickness monitor indicated that the thickness of the copolymer layer was about 60 nm. Then, the coated film was wound up in a roll form.

When a scratching test was performed in the same manner as in Example 1, it was found that no scratching occurred in the deposited layer even when a load of up to 600 g was exerted thereon. On the other hand, scratches occurred under a load of less than 0.1 g in the vapor-deposited layer of tin and stannous sulfide without the vapor-deposited layer of the copolymer of styrene and acrylic acid thereon.

EXAMPLE 4

A roll of a long strip of a 100 μm-thick polyethylene terephthalate film (support) was placed in a semi-continuous vapor depositing apparatus, and in a vacuum of $5\times10^{-5}$ torr bismuth placed in a tungsten crucible was heated to evaporate the bismuth, and the resulting vapor of bismuth was deposited on the film conveyed at a rate of 40 m/min. to form a vapor-deposited bismuth layer. Then, polymethacrylic acid placed in a stainless steel crucible disposed apart from the tungsten crucible with a partition therebetween was heated to evaporate the polymethacrylic acid, and the resulting vapor was deposited on the bismuth layer until a thickness monitor indicated that the thickness of the polymethacrylic acid layer was about 300 nm. Then, the coated film was wound up in a roll form. No conveyor roller was provided between the bismuth deposition section and the polymethacrylic acid deposition section, and after the vapor deposition of the polymethacrylic acid, the film passed two conveyor rollers whose surfaces had a hard chromium plating thereon which contacted the surface of the vapor-deposited layer before it was wound up.

The resulting material having the vapor-deposited layers was carefully observed under transmitted light for pinholes, but only some pinholes which had already occurred in the as-formed vapor-deposited layers were observed, and no increase in pinholes was seen. Furthermore, no defects such as scratches was observed, and a material with good quality vapor-deposited layers was obtained.

A scratching test performed in the same manner as in Example 1 showed that no scratching occurred in the vapor-deposited layers even when a load of up to 900 g was exerted thereon. A vapor-deposited layer only of the bismuth without polymethacrylic acid layer thereon had a scratch resistance of less than 0.1 g.

EXAMPLE 5

A material with vapor-deposited layers of aluminum and polymethacrylic acid thereon was prepared in the same manner as set forth in Example 4 except that aluminum was used instead of bismuth.

The same scratching test as in Example 1 showed that no scratching occurred even when a load of 850 g was exerted thereon.

EXAMPLE 6

A material with vapor-deposited layers of aluminum and behenic acid thereon was prepared in the same manner as in Example 5 except that behenic acid was used instead of the polymethacrylic acid.

The same scratching test as in Example 1 showed that no scratching occurred even when a load of 550 g was exerted thereon.

EXAMPLE 7

A roll of a long strip of a 100 μm-thick polyethylene terephthalate film (support) was placed in a semi-continuous vapor depositing apparatus, and in a vacuum of $5\times10^{-5}$ torr, indium placed in a tungsten crucible was heated to evaporate the indium, and the resulting vapor was deposited on the film conveyed at a rate of 40 m/min. to form a vapor-deposited indium layer thereon having a thickness of about 60 nm (transmission optical density: 3.5). Then, rosin placed in a stainless steel crucible disposed next to but separated by a partition from the tungsten crucible was heated, and the vapor was deposited on the vapor-deposited indium layer until a thickness monitor indicated that the thickness was about 100 nm. Then, the coated film was wound up in a roll form. No conveyor roller was provided between the indium deposition section and the rosin deposition section, and after the vapor deposition of rosin, the film passed two conveyor rollers whose surfaces had a hard chromium plating thereon which contacted the surface of the vapor-deposited layer before it was wound up.

When the resulting vapor-deposited layers were carefully observed under transmitted light, only some pinholes which had already occurred in the as-formed vapor-deposited layers were observed, and no increase in pinholes was seen. Moreover, defects such as scratches were not observed, and the resulting vapor-deposited layers had a good quality.

The support having indium and rosin layers vapor-deposited thereon by the procedures set forth hereinabove which had been wound up in a roll form was set in a continuous coating machine. This support was conveyed at a rate of 15 m/min., and a methyl ethyl ketone solution of cellulose acetate butyrate was coated on the rosin-deposited layer, and dried to form a recording material having a coating of the cellulose acetate butyrate on top.

In the coating machine, the surface of the vapor-deposited layer passed two conveyor rolls with a hard chromium-plated surface in the path from the delivery section to the coating section.

When the resulting recording material was carefully observed under transmitted light for pinholes, it was found that there was hardly any increase in pinholes.

When this recording material was subjected to line scanning using an argon laser light having a wavelength of 488 nm with a beam diameter of 10 μm, the indium layer was melted, and deformed at those parts which had been irradiated with the laser light. These portions became transparent, and the scanning tracks of the laser light were recorded.

EXAMPLE 8

A roll of a long strip of a 100 μm-thick polyethylene film (support) was placed in a semi-continuous vapor deposition apparatus, and in a vacuum of $5\times10^{-5}$ torr, tin placed in a tungsten crucible and stannous sulfide placed in a tungsten crucible juxtaposed to the first tungsten crucible were heated, and the vapors were deposited on the film conveyed at a rate of 20 m/min. to form vapor-deposited laminate film having a thickness of about 130 nm (transmission optical density: 4.0) in which the tin contacted the stannous sulfide. Then, a copolymer of styrene and acrylic acid (weight ratio of 74.3:25.7) placed in a stainless steel crucible disposed next to the second tungsten crucible but separated therefrom by a partition was heated, and the vapor was vapor-deposited on the vapor-deposited laminate layer of tin and stannous sulfide until a thickness monitor indicated that the thickness of the copolymer layer was about 60 nm. Then, the coated film was wound up in a roll form.

Then, the same procedure as in Example 6 was repeated except that argon laser light having a wavelength of 488 nm with a beam diameter of 70 μm was used. The same results as in Example 7 were obtained.

EXAMPLE 9

A roll of a long strip of a 100 μm-thick polyethylene film (support) was placed in a semi-continuous vapor deposition apparatus, and in a vacuum of $5\times10^{-5}$ torr, bismuth placed in a tungsten crucible was heated, and the resulting vapor was deposited on the film conveyed at a rate of 40 m/min. to form a vapor-deposited bismuth layer having a thickness of about 75 nm (transmission optical density: 4). Then, polymethacrylic acid placed in a stainless crucible disposed next to the tungsten crucible but separated therefrom by a partition was heated, and the resulting vapor was deposited on the vapor-deposited bismuth layer until a thickness monitor indicated that the thickness of the polymethacrylic acid layer was about 100 nm. Then, the vapor-deposited film was wound up in a roll form. No conveyor roll was provided between the bismuth deposition section and the polymethacrylic acid deposition section, and after the vapor deposition of the polymethacrylic acid, the film passed two conveyor rollers, whose surfaces had a hard chromium plating thereon which contacted the surface of the vapor-deposited layer before it was wound up.

The vapor-deposited layers were carefully observed under transmitted light for pinholes, and only some pinholes which had already occurred in the as-formed vapor-deposited layer were observed, and no increase in pinholes was seen. Moreover, defects such as scratches were not observed, and the resulting vapor-deposited layers had a good quality.

The support having bismuth and polymethacrylic acid layers vapor-deposited thereon, which had been wound up in a roll form, was set in a continuous coating machine. The support was conveyed at a rate of 15 m/min., and an ethylene chloride solution of a copolycondensate of terephthalic acid/ethylene glycol/triethylene glycol was coated on the polymethacrylic acid vapor-deposited layer, and dried to form a recording material having a top coating.

In the coating machine, the surface of the vapor-deposited layer passed two conveyor rolls having a hard chromium-plated surface in the path from the delivery section to the coating section. The recording material so produced was carefully observed under transmitted light for pinholes, but scarcely any increase in pinholes was observed.

The recording material was subjected to instantaneous flash exposure through an image- bearing mask using a xenon discharge tube (SANPAK, 107 electronic flash: output 70.56 Watt-sec). The exposed areas became permeable, and the image of the mask was transferred. Thus, an image of good quality was obtained which had only a low pinhole density which did not cause any practical problems.

EXAMPLE 10

A roll of a long strip of a 100 μm-thick polyethylene terephthalate film (support) was placed in a semi-continuous vapor depositing apparatus, and in a vacuum of $5\times10^{-5}$ torr, an $Al_5Fe_2$ alloy placed in a graphite carbon crucible was heated to evaporate the alloy, and the resulting vapor was deposited on the film conveyed at a rate of 40 m/min. to form a vapor-deposited layer of the Al-Fe alloy having a thickness of about 70 nm (transmission optical density: 4). Then, a mixture of abietic acid and behenic acid (weight ratio: 50:50) placed in a stainless steel crucible disposed next to the graphite crucible but separated by a partition therefrom, and the resulting vapor was deposited on the Al-Fe vapor-deposited layer until a thickness monitor indicated that the thickness of the layer of the mixture of abietic acid and behenic acid was about 400 nm. Then, the coated film was wound up in a roll form. No conveyor roll was provided between the Al-Fe alloy deposition section and the section for vapor depositing the mixture of abietic acid and behenic acid, and after the vapor deposition of the abietic acid/behenic acid mixture, the film passed two conveyor rollers whose surfaces had a hard chromium plating thereon which contacted the vapor-deposited surface before it was wound up.

The resulting vapor-deposited layer was carefully observed under transmitted light for pinholes, and it was found that only some pinholes which had occurred in the as-formed vapor-deposited layer were observed, and no increase in pinholes was seen. Moreover, defects such as scratches were not observed, and the vapor-deposited layers obtained had a good quality.

The support having the Al-Fe alloy and the mixture of abietic acid and behenic acid vapor-deposited thereon, which had been wound up in a roll form, was set in a continuous coating machine.

The support was conveyed at a rate of 15 m/min., and a solution of a methyl methacrylate/methacrylic acid copolymer (85:15 weight ratio), pentaerythritol tetraacrylate, and N-methyl-2-benzoyl methylene-β-naphthothiazole in a mixture of methyl ethyl ketone and methyl Cellosolve acetate was coated on the film, and dried to produce an image-forming material having a layer of a photosensitive resin formed thereon.

In the coating machine, the surface of the vapor-deposited layer passed two conveyor rolls having a hard chromium-plated surface from the delivery section to the coating section. The resulting image-forming material was carefully observed under transmitted light for pinholes, but scarcely any increase in pinholes was observed.

The image-forming material obtained was exposed through an image-bearing mask for 40 seconds using an exposing device (PS Light, 2 kW metal halide lamp; a product of Fuji Photo Film Co., Ltd.) with the image-forming material disposed at a distance of 1 m from the light source. The unexposed areas in the photosensitive layer and the vapor-deposited layer were removed by washing with an aqueous solution (400 ml $H_2O$) of sodium hydroxide (0.6 g), sodium hypochlorite (60 ml aq.soln.; effective Cl: 5%) and sodium phosphate dodecahydrate for 25 seconds. Thus, an image of good quality was formed which had a very low pinhole density which did not cause any practical difficulty.

EXAMPLE 11

A film having vapor-deposited layers of an Al-Fe alloy and polymethacrylic acid was prepared in the same manner as in Example 9 except that an $Al_5Fe_2$ alloy was used instead of the bismuth. In the same manner as in Example 10, a layer of a photosensitive resin was formed on the vapor-deposited layer of polymethacrylic acid to produce an image-forming material.

The image-forming material was carefully observed under transmitted light for pinholes, but scarcely any increase in pinholes was observed. An image of good quality as in Example 10 was obtained using the same exposure and development as in Example 10.

EXAMPLE 12

A film having bismuth and behenic acid vapor-deposited thereon was produced in the same manner as in Example 9 except that behenic acid was used instead of the polymethacrylic acid. Using quite the same method as in Example 10, a solution of an adduct formed between an acetone/pyrogallol condensate (n=3) and 2-diazo-1-naphthol-4-sulfonyl chloride and a novolac-type phenolic resin dissolved in β-acetoxy ethyl methyl ether (methyl Celloslve acetate) and 1,2-dichloroethane was coated on the vapor-deposited layer to form a photosensitive resin layer thereon. The resulting image-forming material was carefully observed under transmitted light for pinholes. A slight increase in pinholes was observed, but this was not detrimental to practical use.

The resulting image-forming material was exposed through a pattern-like image-bearing mask for 40 seconds at a distance of 1 m from a PS Light (2 KW, a metal halide lamp, a product of Fuji Photo Film Co., Ltd.). It was developed for 50 seconds with an aqueous solution of sodium silicate (JIS No. 1), and rinsed, followed by etching away the uncovered bismuth layer with a 10% aqueous solution of ferric chloride. An image of good quality was formed.

EXAMPLE 13

In the same manner as in Example 1, a vapor-deposited indium layer having a thickness of about 60 nm (transmission optical density: 3.5) was formed on a 100 μm-thick polyethylene terephthalate film, and a vapor-deposited layer of rosin having a thickness of about 100 nm was formed on top of the indium layer, and the film was wound up in a roll form. Then, in the same manner as in Example 7, a methyl ethyl ketone solution of cellulose acetate butyrate was coated on the rosin layer to produce a recording material. The recording material was subjected to line scanning using an argon laser light in the same manner as in Example 7, and the same results as in Example 7 were obtained.

EXAMPLE 14

In the same manner as in Example 2 except that an Al-Fe alloy layer having a thickness of about 70 nm (transmission optical density: 3.5) was formed using a metal alloy of the composition $Al_5Fe_2$, and then a layer of a mixture of abietic acid and behenic acid (weight ratio of 50:50) having a thickness of about 400 nm was formed on the metal layer, a 100 μm-thick polyethylene terephthalate film having these layers vapor-deposited thereon was formed. Then, the coated material was wound up in a roll form.

In the same manner as in Example 10, a photosensitive resin layer was formed on the layer of the abietic acid/behenic acid mixture to form an image-forming material. The image-forming material was exposed imagewise and processed in the same manner as in Example 10, and the same results as in Example 10 were obtained.

While the invention has been described in detail and with reference to specific embodiments thereof, it will be apparent to one skilled in the art that various changes and modifications can be made therein without departing from the spirit and scope thereof.

What is claimed is:

1. A process for producing an image recording material which comprises, in sequence, a layer selected from the group consisting of a layer of a metal, a layer having different metals in contact with each other, a layer of a metal alloy, a layer having a metal and a metal compound in contact with each other and a layer of a metal compound which is free from pinholes and scratches, an organic material layer and a layer of an organic resin or an organic resin composition, which process comprises sequentially vapor depositing a layer of a member selected from the group consisting of a metal, a layer having different metals in contact with each other, a layer of a metal alloy, a layer having a metal and a metal compound in contact with each other and a layer of a metal compound on a moving support by evaporating a member selected from said group into the vapor state and then condensing the same on said moving support to form the layer selected from the group consisting of a layer of a metal, a layer having different metals in contact with each other, a layer of a metal alloy, a layer having a metal and a metal compound in contact with each other and a layer of a metal compound having a thickness of about 30 to about 600 nm on said support, then evaporating said organic material into the vapor state and then condensing the same on the thus deposited layer selected from the group consisting of a layer of a metal, a layer having different metals in contact with each other, a layer of a metal alloy, a layer having a metal and a metal compound in contact with each other and a layer of a metal compound on the moving support to form the organic material layer having a thickness of about 30 to about 600 nm, wherein said organic material is a compound selected from the group consisting of homopolymers and copolymers having a recurring unit derived from a member selected from the group consisting of acrylic acid or methacrylic acid; rosin, abietic acid, neoabietic acid, dihydroabietic acid, tetrahydroabietic acid, d-pimaric acid, phthalic acid, isophthalic acid, terephthalic acid, succinic acid, sulfanilic acid, Rhodamine B, saturated fatty acids containing 14 to 29 carbon atoms, a phthalocyanine, a monosaccharide and an oligosaccharide, winding up the support having the layer selected from the group consisting of a layer of a metal, a layer having different metals in contact with each other, a layer of a metal alloy, a layer having a metal and a metal compound in contact with each other and a layer of a metal compound and the organic material layer, unwinding said support, and subsequently forming a layer of a member selected from the group consisting of an organic resin or an organic resin composition on the organic material layer, wherein the vapor depositing is carried out in a vapor deposition chamber for forming and depositing vapors from the evaporating material for forming the layer selected from the group consisting of a layer of a metal, a layer having different metals in contact with each other, a layer of a metal alloy, a layer having a metal and a metal compound in contact with each other and a layer of a metal compound being vapor deposited on said moving support in a manner such that the layer selected from the group consisting of a layer of a metal, a layer having different metals in contact with each other, a layer of a metal alloy, a layer having a metal and a metal compound in contact with each other and a layer of a metal compound is not in contact with any material other than the support.

2. The process of claim 1, wherein the support is a polymeric material having a glass transition temperature of at least about 0° C., a composite of said polymeric material and paper, or paper.

3. The process of claim 2, wherein the support is an organic polymeric film having a glass transition temperature of at least about 0° C.

4. The process of claim 3, wherein the support is a polyethylene terephthalate film.

5. The process of claim 1, wherein the evaporable organic material is selected from the group consisting of polyacrylic acid, polymethacrylic acid, a copolymer of acrylic acid and methacrylic acid, a copolymer of benzyl acrylate and acrylate acid, a copolymer of benzyl methacrylate and acrylic acid, a copolymer of benzyl methacrylate and methacrylic acid, a copolymer of styrene and acrylic acid, a copolymer of styrene and methacrylic acid, a copolymer of phenethyl acrylate and acrylic acid, a copolymer of phenethyl acrylate and methacrylic acid, a copolymer of phenethyl methacrylate and acrylic acid, or a copolymer of phenethyl methacrylate and methacrylate.

6. The process of claim 1, wherein the evaporable organic material is selected from the group comsisting of myristic acid, palmitic acid, stearic acid, arachidic acid, behenic acid, lignoceric acid, and cerotic acid.

7. The process of claim 1 wherein the layer on the vapor-deposited organic material layer is a photo-sensitive layer.

8. The process of claim 1 wherein the layer on the vapor-deposited organic material layer is a non-photosensitive layer.

9. The process of claim 1, wherein the vapor depositing of the layer selected from the group consisting of a layer of a metal, a layer having different metals in contact with each other, a layer of a metal alloy, a layer having a metal and a metal compound in contact with each other and a layer of a metal compound is by vacuum evaporation.

10. The process of claim 1, wherein the vapor depositing is performed with the evaporating material for forming the layer selected from the group consisting of a layer of a metal, a layer having different metals in contact with each other, a layer of a metal alloy, a layer having a metal and a metal compound in contact with each other and a layer of a metal compound in a deposition chamber at a pressure of about $10^{-3}$ torr to about $10^{-6}$ torr, and with the evaporating material for forming the organic material layer in a deposition chamber at a pressure of about $10^{-1}$ torr to about $10^{-4}$ torr.

11. The process of claim 1, wherein the evaporating material for forming the layer selected from the group consisting of a layer of a metal, a layer having different metals in contact with each other, a layer of a metal alloy, a layer having a metal and a metal compound in contact with each other and a layer of a metal compound is at least one member selected from the group consisting of aluminum, antimony, beryllium, bismuth, cadmium, chromium, copper, gallium, germanium, gold, indium, cobalt, iron, lead, magnesium, manganese, nickel, palladium, rhodium, selenium, silicon, silver, strontium, tellurium, titanium, tin, tungsten, molybdenum, vanadium, zinc, an aluminum-silver alloy, an aluminum-bismith alloy, an aluminum-rion alloy, a bismuth-indium alloy, a bismuth-tin alloy, an indium-tin alloy, an iron-cobalt alloy and stannous sulfide.

12. The process of claim 1, wherein any vapor depositing is by a vacuum evaporation.

13. The process of claim 1, wherein said moving support is fed from delivery spindle means through said sequential vapor deposition and then wound up upon wind-up spindle means, no delivery means being used between said sequential depositions.

14. The process of claim 1, wherein said partition is mid-way between said evaporating materials.

* * * * *